United States Patent [19]

Doyel

[11] 4,413,847

[45] Nov. 8, 1983

[54] RUG HOOKING TOOL FOR HOBBY USERS

[76] Inventor: John S. Doyel, 404 W. 20th St., New York, N.Y. 10011

[21] Appl. No.: 244,287

[22] Filed: Mar. 16, 1981

[51] Int. Cl.[3] ..... B65H 69/04

[52] U.S. Cl. ..... 289/17; 289/18.1

[58] Field of Search ..... 289/18.1, 17; 28/147; 139/1 R, 4; 112/80; 223/104

[56] References Cited

U.S. PATENT DOCUMENTS

| | | | |
|---|---|---|---|
| 2,150,024 | 3/1939 | Clack | 289/18.1 X |
| 2,873,766 | 2/1959 | Jeandupeux | 139/1 |
| 3,230,982 | 1/1966 | Sims | 139/1 |
| 3,541,980 | 11/1970 | Barker | 112/80 |
| 3,783,478 | 1/1974 | Osterhout | 28/147 |
| 3,857,153 | 12/1974 | Montory et al. | 28/147 X |
| 3,860,155 | 1/1975 | Migliaccio | 223/104 |
| 4,182,527 | 1/1980 | Meehan | 289/18.1 X |
| 4,229,864 | 10/1980 | Rankin | 28/147 |

FOREIGN PATENT DOCUMENTS

| | | | |
|---|---|---|---|
| 86921 | 10/1976 | Australia | 289/18.1 |
| 206023 | 11/1923 | United Kingdom . | |
| 612465 | 11/1948 | United Kingdom . | |

*Primary Examiner*—Louis Rimrodt

[57] ABSTRACT

A rug hooking tool to be used in place of the conventional latch hook. The tool has a closed integral loop of a firm material which extends forwardly from a handle and can be inserted into canvas to knot lengths of yarn thereto. The handle can comprise a shank received into a shell such that a magazine is formed there between for lengths of yarn which can slide therein forwardly onto the loop. The shank and shell can be separable to allow the shank to mate with a loader for loading the magazine with lengths of yarn. One type of loader uses windings of a continuous length of yarn which are cut into individual lengths in the course of loading the magazine. Another type uses precut lengths of yarn. The same magazine and loaders can be used with a tool having a conventional latch hook tip.

13 Claims, 20 Drawing Figures

Fig. 7.
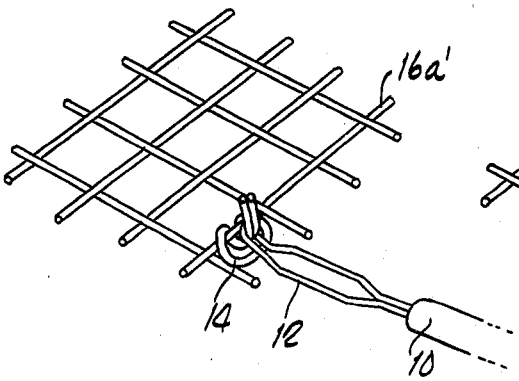
Fig. 8.
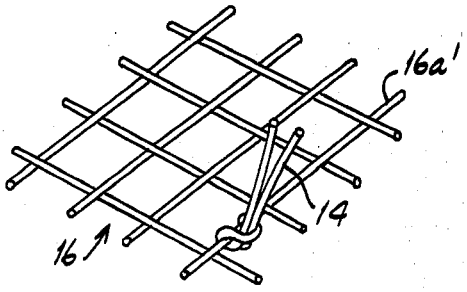
Fig. 9.
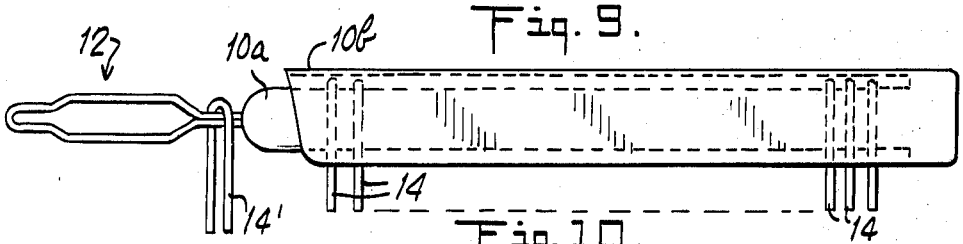
Fig. 10.
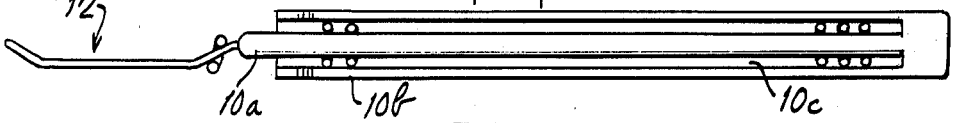
Fig. 11.
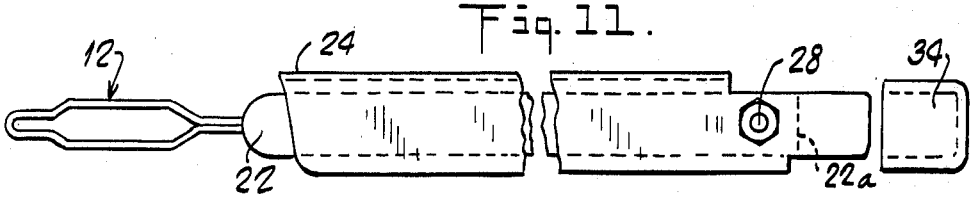
Fig. 12.
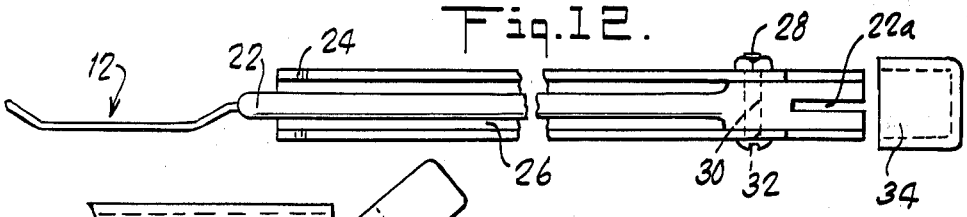
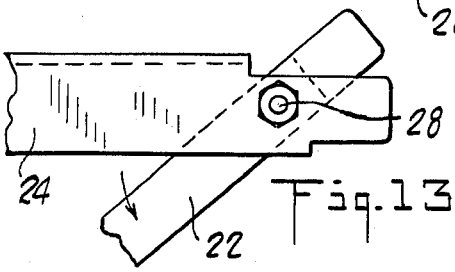
Fig. 13.

Fig. 20.
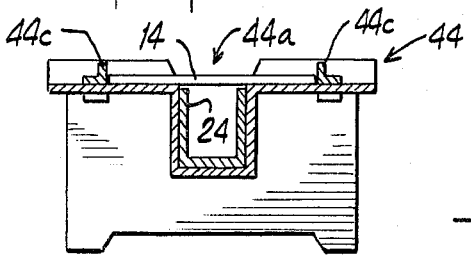
Fig. 18
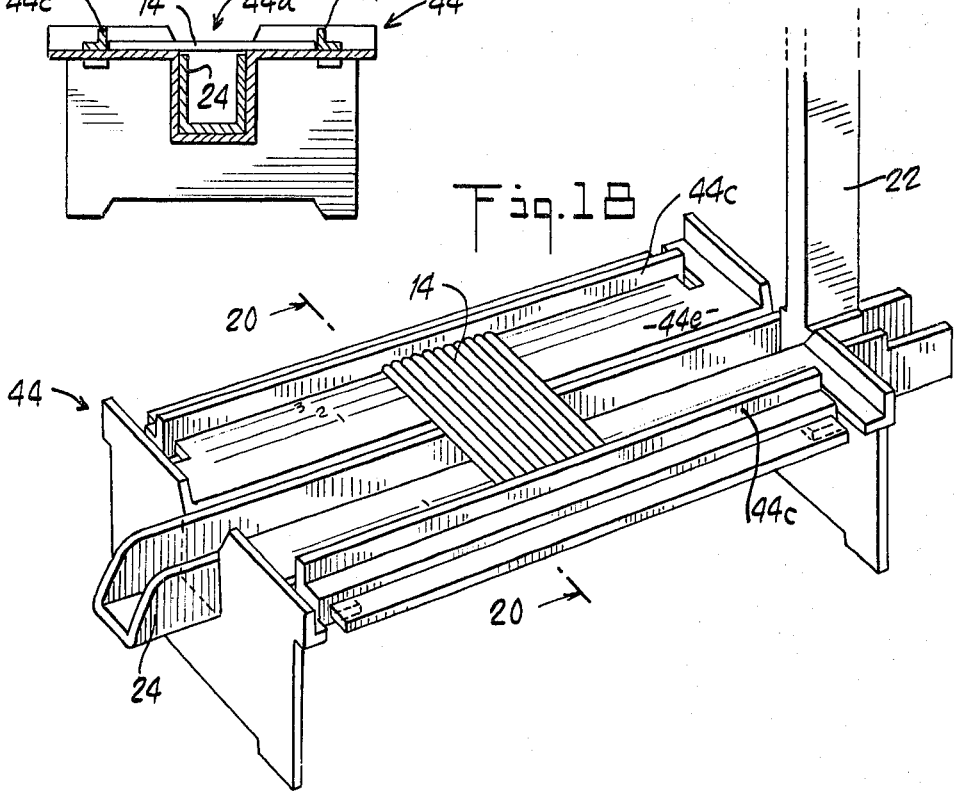
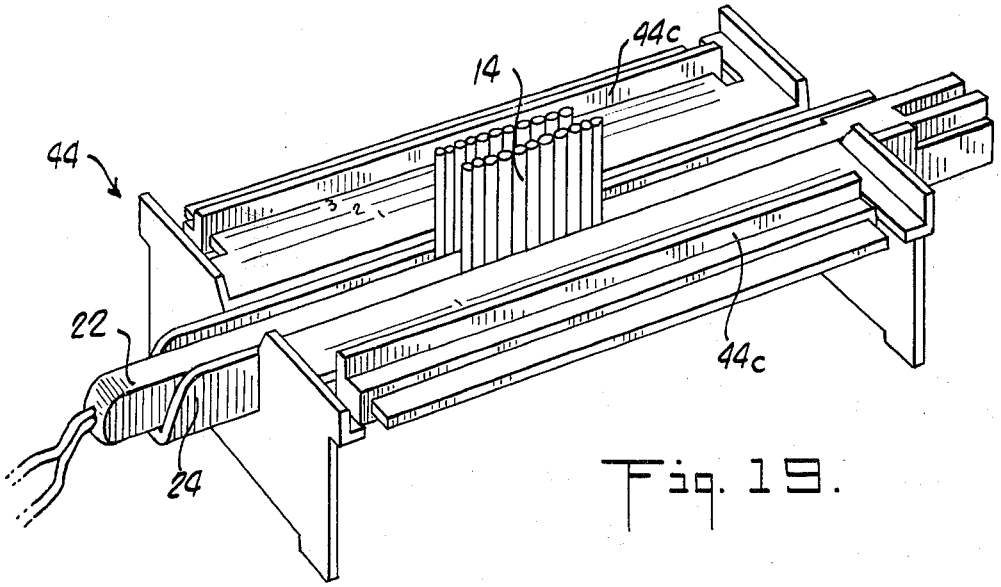
Fig. 19.

HOOKING TOOL FOR HOBBY USERS

BACKGROUND AND SUMMARY OF THE INVENTION

The invention is in the field of rug hooks (or latch hooks) of the kind used by hobbyists to make rugs by knotting (or hooking) lengths of yarn to a support mesh typically called a canvas. More specifically, the invention relates to a new rug hooking tool which includes a tool having a tip which replaces the conventional latch hook tip but serves the same function of helping knot a piece of yarn to the canvas, a magazine in the tool (or in a tool having a conventional tip) for lengths of yarn, and a convenient loader for such magazine.

Conventional latch-hooks, for example as proposed in U.S. Pat. No. 3,541,980, have been used for a long time. U.S. Pat. No. 3,860,155 proposes another type of a latch-hook in which the hook portion can be opened by a button at the front part of the handle, presumably to facilitate use of that hook. U.S. Pat. No. 3,230,982 proposes yet another rug making device having a plunger for pushing the free ends of a length of yarn into a wire loop which appears to have an oval shaped front portion. Other devices for hooking or knotting lengths of yarn to a support are proposed in U.S. Pat. No. 2,873,766 and British Pat. Nos. 612,465 (accepted 1948) and 206,023 (accepted 1923). In addition, said U.S. Pat. No. 3,541,980 proposes a yarn loop holding means to hold one or a plurality of yarn loops while the latch-hook is being threaded into the canvas.

Latch-hooks are used extensively in hobby rug making, and it is believed that a need exists for improvements which could make it more convenient and perhaps less expensive to enjoy the hobby. The invention herein is directed to meeting such a need.

In its simplest form, an exemplary embodiment of a rug hooking tool in accordance with the invention comprises a handle and a closed integral loop of a firm material which extends forwardly from the handle and has a greater width portion which smoothly narrows forwardly to a lesser width tip. The greater width portion is dimensioned to receive freely the free ends of lengths of yarn while the lesser width tip is dimensioned to receive said free ends more tightly and to facilitate pulling said free ends in knotting the length of yarn to the canvas. The fact that no latch is used makes the system less expensive to manufacture and is also believed to make it more convenient to use. The shape of the loop, particularly the relative dimensions of the greater width portion thereof, the lesser width tip thereof and the yarn which is typically used are believed to make the system significantly more effective as compared to a device of the type proposed in said U.S. Pat. No. 3,230,982.

In order to make the system yet more convenient to use, another exemplary embodiment thereof includes a magazine for a number of lengths of yarn which the user can slide individually toward the loop and use in knotting to the canvas. In order to form the magazine the handle comprises an elongated shank and a channel section shell receives the shank but allows a sufficient shell-to-shank clearance which serves to form such a magazine. The shank and shell can be pivotally connected to each other at their back ends so that the front portions thereof can pivot away from each other to facilitate loading the magazine with lengths of yarn. Once the magazine is loaded, a suitable means such as a cap is used to affix the back ends of the shank and shell to each other so as to resist such pivoting. Loading is facilitated with a frame which mates with the shank in one embodiment and the shell in another (when the shank and shell are pivoted away from each other), so as to use in one embodiment windings of a continuous length of yarn which can then be cut into individual lengths, and to use in the other embodiment pre-cut individual lengths of yarn. For use with a continuous length of yarn the loader comprises a frame which mates with the shank to provide a combined shank-and-loader circumference which matches the desired length of yarn for use in making the rug. A continuous length of yarn is wound around such a circumference, in the form of a row of windings extending along the length of the shank, then the shank and shell are pivoted toward each other to form said magazine, the windings are cut at points thereof far from the shank and the loader frame is removed to leave the magazine loaded and ready to use. Alternately, the shank and shell are pivoted from each other and the shell is laid into a trough centrally formed in a loader platform, a row of individual, pre-cut lengths of yarn is arranged on the platform, with the individual lengths of yarn being transverse to the length of the shell and with the row extending along said length, and said magazine is formed and loaded by pivoting the shank toward the shell and using it to push the central parts of the lengths of yarn into the shell.

BRIEF DESCRIPTION OF THE DRAWINGS

FIGS. 3–8 illustrate the use of the tool to knot a length of yarn to canvas.

FIG. 9 is a top view of a modified tool incorporating a magazine for lengths of yarn, and FIG. 10 is a side view thereof.

FIG. 11 is a top view of another modified tool incorporating a magazine for lengths of yarn and comprising a shank and a shell which can pivot away from each other;

FIG. 12 is a side view thereof and

FIG. 13 is a partial top view illustrating the manner in which the shank and shell pivot.

FIG. 18 is a perspective view illustrating the tool of FIGS. 11 and 12 as combined with a loader for individual lengths of yarn;

FIG. 19 is a view similar to that of FIG. 18 but with the shank and shell closed to form a magazine containing a number of individual lengths of yarn; and FIG. 20 is a sectional view taken along line 20—20 in FIG. 18.

DETAILED DESCRIPTION

Figure 1:
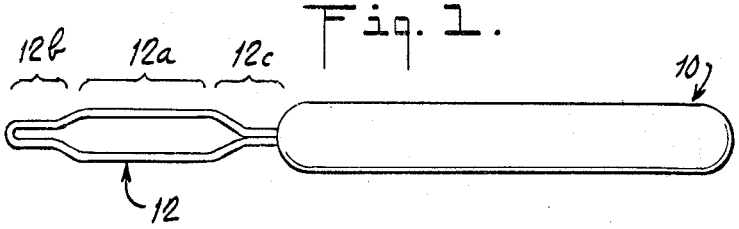
FIG. 1 is a top view of a rug hooking tool embodying the invention.
Figure 2:
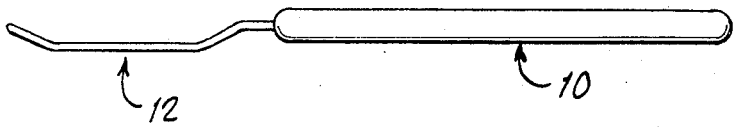
FIG. 2 is a side view thereof.

Referring to FIGS. 1 and 2, a simple rug hooking tool embodying the invention comprises a tool having a handle 10 and a closed integral loop 12 of a firm material which extends forwardly from the handle 10 and comprises a greater width portion 12*a* which smoothly narrows forwardly to a lesser width tip 12*b*. The loop 12 can have a lesser width neck 12*c* affixed to the handle 10. Alternately, the greater width portion 12*a* can be affixed directly to the handle 10, omitting the neck 12*c*. As seen in FIG. 2, the loop can be bent in the shown manner—first downwardly from the handle 10 and then upwardly at the tip 12*b*, to facilitate insertion thereof into canvas meshes. The handle 10 is made of any convenient material, such as molded plastic material or wood, and is shaped and dimensioned to be conveniently grasped by a user. The loop 12 is made of any convenient material, such as metal wire, which is sufficiently firm for convenient insertion in canvas meshes and yet flexible and resilient so as to retain its approximate shape in use but to bend as needed and to flex back to its approximate original shape. Instead of being made of wire, the loop 12 can be molded integrally of a plastic material or can be formed from sheet stock of metal or plastic material. When the loop 12 is made of material different from that of the handle 10, it can be affixed to the handle in any suitable manner. For example, if the handle 10 is of molded plastic, a metal wire loop 12 can be affixed to the forward end of the handle 10 in the molding process, or it can be friction fitted or glued into a suitable opening (or suitable openings) at the front end of the handle 10. Still alternately, the back end of the loop 12 can be affixed to a key bar (not shown) of a material such as plastic, and such key bar can be affixed, as by friction fitting or gluing with a suitable adhesive, into a suitable keyhole at the front end of the bar 10. When the handle 10 and loop 12 are formed of the same material they can be molded integrally of a plastic material, or can be formed integrally of sheet metal or sheet plastic material, as by stamping, or can be formed integrally from a single piece of metal wire or from two or more such pieces of wire.

The tool illustrated in FIGS. 1 and 2 can be used as illustrated in FIGS. 3–8 to knot lengths of yarn, such as yarn 14, to canvas material 16 having meshes such as 18 and 20 between respective warp runs 16*a* and weft runs 16*b*. For the purposes of this specification the term canvas is used generically to refer to any support having an array of openings (meshes) formed between runs which are generally referred to here as warp and weft runs to designate runs (not necessarily woven) which are in intersecting directions. Each warp or weft run can comprise a single strand of material or two or more strands of material.

Figure 3:
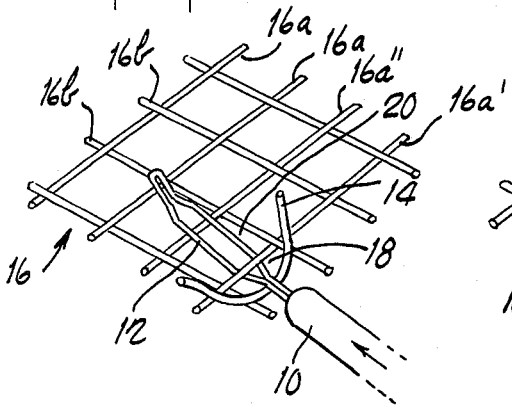
Figure 4:
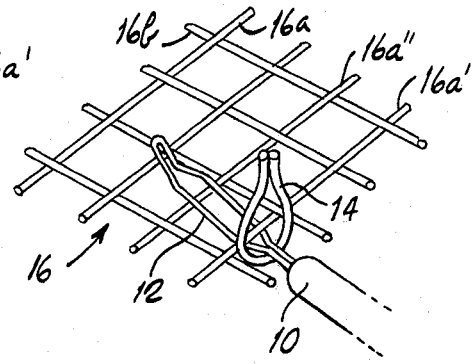
Figure 5:
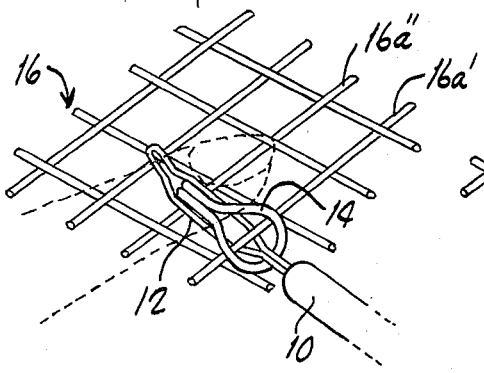
Figure 6:
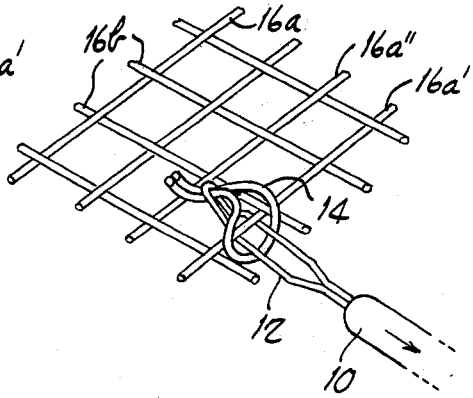

Referring to FIG. 3, the tool illustrated in FIGS. 1 and 2 is used by inserting the loop forwardly and downwardly into a canvas mesh and up into the adjacent mesh such that only a single warp or weft run is over the tool and the tip 12*b* and at least a part of the greater width portion 12*a* of the loop 12 are forwardly of the run while at least a major portion of the handle is rearwardly of the run. (Typically, a rear part of the loop 12 and all of the handle are rearwardly of the run.) In the example of FIG. 3, the tool is inserted forwardly and downwardly into the mesh 18 in canvas 16 such that at least a part of the tip 12*b* is under and forwardly of the warp run 16*a*′ and then the tip 12*b* is moved further forwardly and upwardly into the adjacent mesh 20, for example until at least a part of the tip 12*b* is over the adjacent warp run 16*a*″. A length of yarn 14 is looped around the tool such that a central part of the yarn is just rearwardly of the warp run 16*a*′ and is between the tool and the canvas 16, and such that the free ends of the yarn can extend upwardly from the canvas. Typically, the length of yarn 14 is so looped around the tool prior to inserting the tool into the canvas; however, it can be so looped after the tool is inserted into the canvas. The free ends of the yarn are then brought together, for example as shown in FIG. 4, and may be twisted together if desired, and are pushed forwardly and downwardly, until they extend over the warp run 16*a*′ and are at least partway downwardly into the loop, for example to the position illustrated in FIG. 5, and typically are held in that position by keeping the user's finger pressing lightly over the loop 12, for example as illustrated in FIG. 5. The tool is then withdrawn from the canvas rearwardly, typically while the user keeps a finger tip on the forward part of the tip 12, in the course of which the free ends of the yarn are received in and typically are engaged by the falling innersides and perhaps the inner apex of the tip 12*b*, for example as illustrated in FIG. 6, and the withdrawing motion continues, with the tool pulling the free ends of the yarn through a loop formed by the central part of the yarn 14, for example as illustrated in FIG. 7. The tip 12*b* continues to engage the free ends of the yarn 14 even after the tool is completely out of the canvas 16, and thereby facilitates knotting the length of yarn 14 to the warp run 16*a*′, for example into the knot illustrated in FIG. 8. If the knot is not tightened sufficiently merely by the action of moving the tool away from the canvas 16, it can be tightened more by grasping the free ends of the yarn 14 and pulling them away from the warp run 16*a*′.

The shape and the absolute and relative dimensions of the tool are particularly favorable for convenient operation. For example, the lesser width of the tip 12*b* facilitates insertion of the loop 12 into the canvas; the bent shape of the loop 12 (see FIG. 2) facilitates keeping the tip 12*b* over the warp run 16*a*″ which is next to the run 16*a*′ to which the yarn 14 is knotted, and further facilitates the convenient insertion of the free ends of the yarn 14 into the loop, as the upward bent of the tip 12*b* results in raising the forward part of loop 12 above the canvas 16; the portion 12*a* is sufficiently wide relative to the thickness of the yarn 14 to receive freely the free ends of the yarn but is sufficiently narrow relative to the size of a mesh to be freely inserted therein without distorting the canvas; and the width of the tip 12*b* is sufficiently small relative to the thickness of the yarn 14 to receive the yarn tightly enough to be of help in getting the free ends of the yarn through the loop formed by the central part of the length of yarn and to form an acceptably tight knot. Moreover, the resiliency of the loop, particularly when the loop is bent by vertical forces in use, provides a snap action which further facilitates the formation of a satisfactory knot. More specifically, when the tool is pulled rearwardly (as in FIG. 6) some upward pressure is typically exerted on the warp run 16*a*′ to bend the loop 12 downwardly. As the tip 12*b* clears the warp run 16*a*′ (as in FIG. 7) and is freed from the warp run 16*a*, the loop typically tends to snap upwardly, and this upward snap is believed to help keep the free ends of the yarn 14 within the tip 12*b* long enough to allow the formation of a satisfactory knot.

It should be appreciated that the directional terms used above (such as forwardly, rearwardly, up, down and vertically) apply only to a particular exemplary orientation of the relevant components (when the canvas is horizontal), and that appropriate allowances for such directional terms must be made should they be applied to use of the relevant components in other absolute or relative orientations. It should also be appreciated that the description above of knotting a length of yarn to a warp run similarly applies to a weft run.

Referring to FIGS. 9 and 10, a modified tool incorporates a magazine for lengths of yarn and comprises a loop 12 which is generally as that discussed in connection with FIGS. 1–8 and extends forwardly from a handle 10. However, in this case the handle 10 comprises an elongated shank 10*a* received in a channel section shell 10*b* with sufficient shell-to-shank clearance to form a magazine 10*c* for a row of lengths of yarn 14 which are looped around the shank 10*a* and which can slide individually forwardly along the length of the shank and onto the loop 12, for example to the position of yarn 14'. The modified tool of FIGS. 9 and 10 is used to knot lengths of yarn 14 to warp or weft runs 16*a* or 16*b* generally in the manner discussed in connection with the tool of FIGS. 1 and 2, except that the individual lengths of yarn 14 can come from the magazine 10*c* rather than from a different supply. As one example, after the loop 12 has been inserted into the canvas as discussed in connection with FIG. 3, the foremost length of yarn 14 in the magazine 10 is grasped by the free ends and is slid forward onto the loop 12, to the position shown in FIG. 3 or to the position shown in FIG. 4, and is then knotted to the canvas as discussed in connection with FIGS. 4–8. The modified tool of FIGS. 9 and 10 can be preloaded by looping individual lengths of yarn around the exposed foremost part of the shank 10*a* (or around the loop 12) and sliding them rearwardly into the magazine 10*c*. The lengths of yarn loaded into the magazine can be identical to each other or can have different color or other characteristics. In connection with latch-hooking a given rug, a user can have at hand several different modified tools of the type shown in FIGS. 9 and 10, each loaded with lengths of yarn of respective different color or other characteristics in order to create the desired color or other pattern on the rug.

Yet another modified tool is illustrated in FIGS. 11–13 and comprises a loop 12 similar to those in FIGS. 1, 2, 9 and 10, and handle 10'' comprising a shank 22, shell 24 and magazine 26 somewhat similar to the shank 10*a*, shell 10*b* and magazine 10*c* in FIGS. 9 and 10. The difference in the shank 22 and shell 24 is that rather than being rigidly connected to each other, as the shank 10*a* and shell 10*b* are, the shank 22 and shell 24 are secured to each other at the rear thereof by pivot means which can allow the forward portions of the shank 22 and shell 24 to pivot away from each other, for example as illustrated in FIG. 13. The pivot means comprise, in one example, a fastener such as a pin 28 which is received in suitable aligned openings 30 and 32 in the shank and shell respectively, and is suitably affixed to the shell opening, as by friction fitting or adhesives, while being rotatably received in a looser fit in the opening 30 in the shank. In the alternative, the pin 28 may be replaced by a bolt having a bolthead outside one of the openings 32 in the shell and a nut threaded onto a portion of the bolt extending outside the other opening 32 in the shell 24. The shank 22 and shell 24 have respective reduced size portions at the back end thereof, where the shank has only two falling sides (to allow pivoting of the shank therein), and a removable locking cap 34 fits over said reduced size portions to restrain the shell and shank from pivoting away from each other when in place, but to allow the shell and shank to pivot away from each other, as illustrated in FIG. 13, when the locking cap 34 is removed.

The tool illustrated in FIGS. 11–13 is primarily for right-hand use, to be grasped such that the top part of the shell 24 (as seen in FIG. 11) is against the palm of the right hand. However, the tool can be converted easily to left-hand use by removing pin 28 to disconnect shank 22 from shell 24, rotating shank 22 by 180° about its long axis and reconnecting it to shell 24 by reinserting pin 28 (or another type of fastener which may be used in place of pin 28). Similarly, while the tool illustrated in FIGS. 9 and 10 is primarily for right-hand use, a similar tool for left-hand use can be made by molding (or otherwise assembling) the shank 10*a* and shell 10*b* such that the shank is at a position which is 180° away (around the long axis of the shank) from the position shown in FIGS. 9 and 10. In the alternative, in the embodiments of the tools of FIGS. 9–13 in which the tip 12 is removable from the shank, the tool can be changed between right and left-hand operation by removing the tip from the shank, rotating it 180° about its long axis and reinserting it in the shank.

The pivoting action of the modified tool of FIGS. 11–13 allows the tool to mate with a yarn loader which helps load the magazine 26 with lengths of yarn. One type of loader and the use thereof as illustrated in FIGS. 14–17 and another type of loader and the use thereof are illustrated in FIGS. 18–19.

Figure 14:
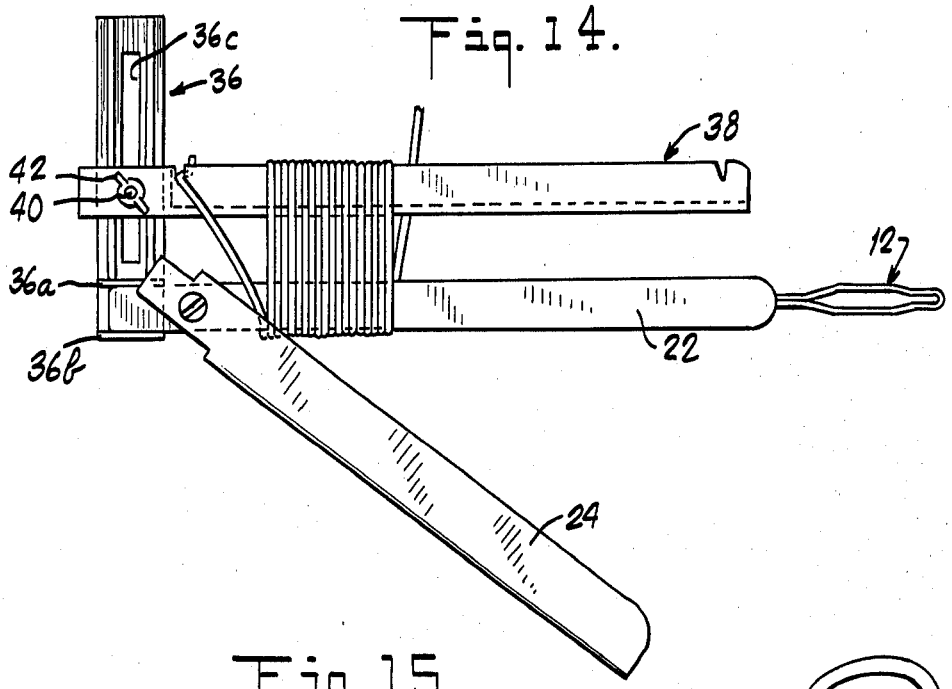
FIG. 14 is a top view of the modified tool of FIGS. 11 and 12 as combined with a loader which uses a continuous length of yarn.
Figure 15:
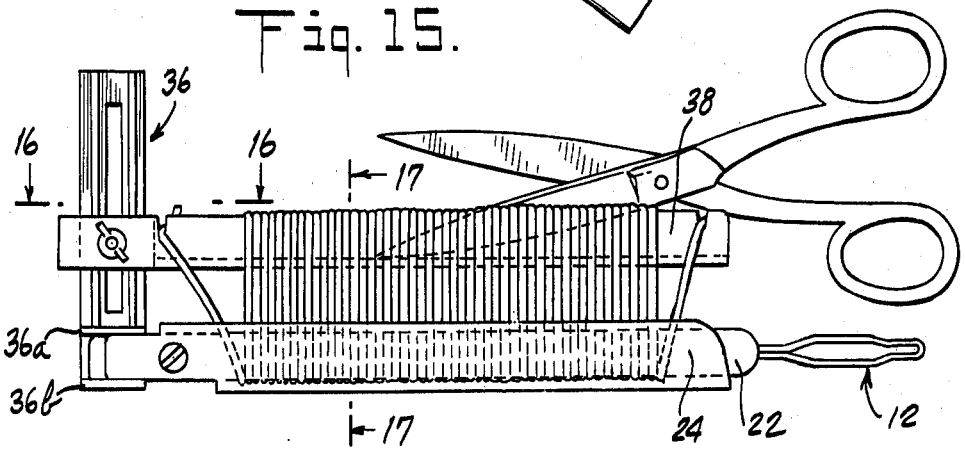
FIG. 15 is a view similar to that of FIG. 14 but with the magazine closed and illustrates the manner in which the continuous length of yarn is cut into individual lengths of yarn loaded in the magazine.
Figure 16:
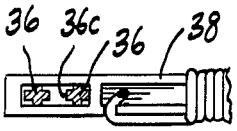
FIGS. 16 and 17 are sectional views along lines 16—16 and 17—17 respectively in FIG. 15.
Figure 17:
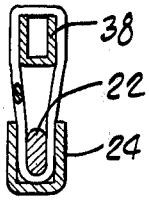

Referring to FIGS. 14–17, the loader comprises a T-shaped frame made up of a stem 36 and an arm 38. The lower part of the stem fits slidingly and tightly into a slot 22*a* (FIG. 12) at the back end of the shank 22 such that the shank remains between two sets of flanges 36*a* and 36*b* which serve as guides for the back end of the shank, and the arm 38 has at its back end a slot similar to that in the shank 22 and similarly receiving the stem 36. A bolt 40 having a wing nut 42 passes through suitable openings at the parts of the arm 38 which form the slot at its back end, and through a vertically extending slot 36*c* in the stem, allowing the arm 38 to slide up and down the stem 36 and to be releasably affixed to the stem (by tightening the wing nut 42) at any selected distance between the shank 22 and the arm 38. In use, the cap 34 (FIGS. 11, 12) is removed by pulling it rearwardly from the handle 10'', the shell 24 is pivoted away from the shank 22 (for example to the position shown in FIG. 14) and the loader frame is mated with the shank 22 by inserting the lower part of the stem 36 into the slot 22*a* as shown in FIG. 14. If desired, the wing nut 42 is loosened and the arm 38 is moved up or down the stem 36 until the combined shank and loader (i.e. shank 22 and loader arm 38) circumference matches the desired length of yarn for knotting to the canvas, at which time the wing nut 42 is tightened again. One end of the continuous length of yarn is secured to a notch 38*a* and is then wound around the combined shank and arm circumference, in adjacent windings arranged next to each other along the length of the shank 22 and arm 38, for example until the windings reach another notch 38*b*, and the continuous length of yarn is secured thereto as shown in FIG. 15. The shell 24 is then pivoted toward the shank 22, to the position shown in FIG. 15, to retain the individual lengths of yarn which are formed in the following step of cutting the windings, e.g. with scissors as shown, at points away from the shank. To facilitate such cutting, the arm 38 is channel shaped (FIG. 17) with the open side of the channel facing upwardly.

Referring to FIGS. 18–20 an alternate loader comprises a platform 44 having a centrally located trough 44*a* dimensioned to receive loosely the shell 24 of a tool of the kind illustrated in FIGS. 11 and 12. The tool magazine can be loaded by removing the cap 34 (FIGS. 11 and 12), pivoting the shank 22 away from the shell 24, for example to the position shown in FIG. 18, laying at least a part of the shell 24 in the trough 44*a*, and arranging a row of individual lengths of yarn 14 on the platform, with each length 14 being over the shell 24 and extending transversely thereof. To facilitate this arrangement, the platform 44 may have side walls 44*b* and 44*c* which extend upwardly from the lateral borders of a central surface 44*e*. However, longer individual lengths of yarn 14 may be placed with their free ends extending beyond the lateral extent of the side walls 44*b* and 44*c*. Once a row of lengths of yarn 14 has been arranged over the shell 24 in the trough 44*a*, the shank 22 is pivoted downwardly, to push the central parts of the lengths of yarn 14 into the shell 24 and load the magazine.

The free ends of the lengths of yarn 14 in the magazine 26 are even as an inherent result of the loading operation described in connection with FIGS. 14–20, and can be arranged to be even when manually loading the magazine 10*c* of the tool of FIGS. 9 and 10 (and if loading the magazine 26 manually, without the use of the loaders). As a result, the free ends of the lengths of yarn hooked into the canvas 16 (as in FIG. 8) tend to be even, thus giving a more pleasing appearance to the finished rug and eliminating or reducing the need to trim free ends in the finished product. This benefit is in addition to the other benefits of using a magazine in accordance with the invention, which include the convenience of providing the user with a ready supply of lengths of yarn 14 which are already folded into and are easily accessible while the tip 12 (or another type of tip) is in or is being inserted in the canvas 16.

It should be appreciated that numerous modifications are possible within the scope of the invention. For example, shell 10*b* and/or 24 need not encircle the shank on all three sides but may comprise only two arms flanking the shank (e.g. flanking the flat sides of the shank) and being spaced therefrom by a distance which is less than the thickness of the yarn to thereby retain lengths of yarn in a form of a magazine. As another example, either of the handles 10' and 10'' can be used with another latch-hook tip in place of the loop 12 (e.g., a tip such as shank 13 or 13' in said U.S. Pat. No. 3,541,980) in order to provide hobbyists who prefer a conventional latch-hook with the convenience of a magazine such as the magazine 10*c* or 26 and with the convenience of loaders such as that shown in FIGS. 14–17 or that shown in FIGS. 18 and 19.

What I claim is:

1. A rug hooking tool having a handle and a closed, integral loop of firm material which extends forwardly from the handle and comprises a greater width portion which smoothly narrows forwardly to a lesser width tip, said loop being dimensioned to be inserted forwardly into canvas meshes between warp and weft runs such that a warp or weft run is over the loop and such that the tip and at least a part of the greater width portion of the loop are forwardly of said run while at least a major portion of the handle is rearwardly of the run, whereby when the loop is so inserted in the canvas, and there is a length of yarn with a central part thereof just rearwardly of the run and between the tool and the canvas and the free ends thereof extending away from the tool and/or canvas, said yarn length can be knotted to said run by pushing the free ends thereof forwardly over said run and downwardly into the loop and withdrawing the tool from the canvas by moving it rearwardly of said run, said loop being dimensioned in width to receive freely said free ends of the yarn length and said tip being dimensioned in width to receive said free ends relatively tightly in the course of said rearward movement of the tool.

2. A rug hooking tool as in claim 1 in which the handle comprises an elongated shank and a channel section shell which receives the shank while allowing sufficient shell-to-shank clearance to form therebetween a magazine for a row of lengths of yarn looped around the shank which can slide individually forwardly along the length of the shank and onto said loop.

3. A rug hooking tool as in claim 2 in which the handle includes pivot means which secure the shell and shank to each other at the rear thereof but allow the forward portions thereof to pivot away from each other.

4. A rug hooking tool as in claim 3 in which the handle includes means for selectively restraining the shell and shank from pivoting away from each other.

5. A rug hooking tool as in claim 2 including means for selectively moving at least a portion of the length of the shank out of the shell, and a yarn loader mating with one of said shank and shell to assist in loading said magazine with lengths of yarn.

6. A rug hooking tool as in claim 5 in which the loader comprises a frame mating with the shank to provide a combined shank-and-loader frame circumference which matches the desired length of yarn for knotting to said canvas, whereby a continuous length of yarn can be wound around said circumference, in windings arranged next to each other along the length of the shank, and then cut at points thereof away from the shank to provide a row of individual lengths of yarn loaded in said magazine.

7. A rug hooking tool as in claim 6 in which said loader frame comprises means for selectively changing said circumference to thereby allow said magazine to be loaded with lengths of yarn of a selected dimension.

8. A rug hooking tool as in claim 5 in which the loader comprises a platform having a centrally located trough dimensioned to receive loosely at least a major part of the shell, whereby said magazine can be loaded with individual lengths of yarn by separating the shank from the shell at least in part, laying at least a part of the shell in said trough, arranging a row of individual lengths of yarn on said platform, with each individual length of yarn being over the shell and extending transversely thereof, and pushing said lengths of yarn into the shell with the shank to thereby form said magazine and load it with said lengths of yarn.

9. A rug hooking tool as in claim 2, including means for selectively securing the shell and shank to each other but for selectively allowing at least a portion of the shank to be moved out of the shell to load said magazine with lengths of yarn.

10. A rug hooking tool as in claim 9 including a yarn loader mating with one of said shank and shell, when at least a portion of said shank is moved out of the shell, to assist in loading said magazine with lengths of yarn.

11. A rug hooking tool as in claim 10 in which the loader comprises a frame mating with the shank to provide a combined shank-and-loader circumference which matches the desired length of yarn for knotting to said canvas.

12. A rug hooking tool as in claim 1 in which the tip of the loop is angled with respect to the central loop portion to thereby extend upwardly therefrom when the central portion is horizontal.

13. A rug hooking tool as in claim 12 in which the loop is made of a continuous piece of stiff metal wire.

* * * * *